US006802083B2

(12) United States Patent
Yan

(10) Patent No.: US 6,802,083 B2
(45) **Date of Patent: *Oct. 12, 2004**

(54) CAP WITH IMPROVED SUNSHADE

(76) Inventor: Suen Ching Yan, 17145 Margay Ave., Carson, CA (US) 90746

( * ) Notice: Subject to any disclaimer, the term of this patent is extended or adjusted under 35 U.S.C. 154(b) by 0 days.

This patent is subject to a terminal disclaimer.

(21) Appl. No.: 10/645,444

(22) Filed: Aug. 18, 2003

(65) Prior Publication Data

US 2004/0154074 A1 Aug. 12, 2004

Related U.S. Application Data

(63) Continuation-in-part of application No. 10/349,255, filed on Jan. 21, 2003.

(51) Int. Cl.[7] ..... A42B 1/24
(52) U.S. Cl. ..... 2/209.13; 2/175.6; 224/576
(58) Field of Search ..... 2/209.13, 209.11, 2/209.12, 206, 207, 175.6; 206/8

(56) References Cited

U.S. PATENT DOCUMENTS

| | | | | | |
|---|---|---|---|---|---|
| 1,050,310 | A | | 1/1913 | Steinberg et al. | |
| 1,635,916 | A | * | 7/1927 | Millard | 2/46 |
| 2,295,826 | A | | 9/1942 | Brav | |
| 2,472,033 | A | * | 5/1949 | Wetzel | 2/4 |
| 2,844,822 | A | | 7/1958 | Persico et al. | |
| 3,750,192 | A | * | 8/1973 | Beresic | 2/422 |
| 4,386,437 | A | | 6/1983 | Fosher | 2/199 |
| 4,887,319 | A | * | 12/1989 | Daniels | 2/410 |
| 4,980,928 | A | | 1/1991 | Ellis | 2/88 |
| 5,046,195 | A | | 9/1991 | Koritan | 2/172 |
| 5,081,717 | A | * | 1/1992 | Shedd et al. | 2/181.4 |
| 5,355,535 | A | | 10/1994 | Bruder | 2/172 |
| 5,459,881 | A | | 10/1995 | Fagan et al. | 2/209 |
| 5,623,732 | A | | 4/1997 | Olajide, Jr. | 2/195 |
| 5,649,327 | A | * | 7/1997 | Crewe | 2/172 |
| 5,669,075 | A | | 9/1997 | Weeks | 2/172 |
| 5,694,648 | A | | 12/1997 | Nucifora | 2/172 |
| 5,701,609 | A | * | 12/1997 | Bridges | 2/422 |
| 5,742,944 | A | * | 4/1998 | Pfefferman | 2/209.12 |
| D402,088 | S | | 12/1998 | Edwards | D2/865 |
| 5,860,165 | A | | 1/1999 | Cvijanovich | 2/195 |
| 5,887,287 | A | | 3/1999 | Potochnik | 2/209 |
| 5,924,129 | A | | 7/1999 | Gill | 2/10 |
| 5,996,124 | A | * | 12/1999 | Asp, Jr. | 2/209.13 |
| D420,493 | S | | 2/2000 | Blake | D2/866 |
| 6,131,201 | A | | 10/2000 | Chu | 2/172 |
| 6,317,892 | B1 | * | 11/2001 | Galigani | 2/209.11 |
| 6,484,323 | B1 | * | 11/2002 | Pu | 2/410 |

* cited by examiner

*Primary Examiner*—Katherine Moran
(74) *Attorney, Agent, or Firm*—Cislo & Thomas LLP

(57) ABSTRACT

A cap and shade combination in which the shade may be folded inside an attached pouch when not in use. The shade comprises a central portion and two wing portions such that it may be unfurled both down away from the cap and laterally in both directions around the rim of the cap. The extending portion of the shade is of split configuration and of light weight material to be better received within the pouch of the cap.

13 Claims, 5 Drawing Sheets

CAP WITH IMPROVED SUNSHADE

CROSS-REFERENCES TO RELATED APPLICATIONS

This patent application is a continuation-in-part application of application Ser. No. 10/349,255 filed Jan. 21, 2003 and entitled: CAP AND BACK SUNSHADE, which application is incorporated herein by this reference thereto.

BACKGROUND OF THE INVENTION

1. Field of the Invention

This invention relates to caps for wearing outdoors, and in particular, to caps having a shade for shading a portion of the user from the sun.

2. Description of the Related Art

The prior art includes a number of cap and shade combinations. U.S. Pat. No. 6,131,201, for example, discloses a cap having an openable top cover for retaining the shade in an inner space. The sunshade in that patent, however, suffers from, among other things, the fact that the shade is attached to the outside surface of the cap, and is thereby awkward to use and fails to provide the additional support that could be provided had the shade instead been attached to the inside of the cap where the band of the cap tightly fits around the wearer's head. That patent also suffers from the ill placement of the opening from which the sunshade is released. The zipper for the opening is in plain sight, detracting from the aesthetics of the cap.

Also, the opening is far from the attachment features, which means the sunshade must be entirely detached from the cap before placing in the inner space. This increases the chances that the sunshade will be removed by accident and also increases the chances that the sunshade and the cap will be separated and one of the two will be lost. What is needed is a cap and shade combination that may be made of a one-piece construction so the shade is less likely to be separated from the cap and lost. Alternatively, what is needed is a two-piece construction that is much less likely to allow the shade to be accidentally removed, such as where the removable attachments of the shade are on the inside of the cap where the tight fit to the wearer's head can aid in forcing the two pieces together.

SUMMARY OF THE INVENTION

The present invention is a cap and shade combination in which the shade may be folded inside an attached pouch which is permanently attached or detachable when not in use. The shade comprises a central portion and two wing portions such that it may be unfurled both down away from the cap and laterally in both directions around the rim of the cap. Each wing portion has an upper edge comprising one or more shade attachment members configured and positioned to removably attach to mating attachment members on the inner surface of the cap near the front visor when in use for maximum coverage of the user's neck, ears, etc.

In one embodiment, the pouch may be stitched into the cap. In another embodiment, it may be removably attached to the inner surface of the crown of the cap, such as by using a hook and loop attachment configuration or using snaps, buttons, clasps, latches, or other common fasteners. In another embodiment, the pouch may be sewn into or as part of the band or sweatband of the cap. The pouch may further have a zipper or other fastening means for alternatively enclosing and releasing the shade. Where the pouch is sewn into or as part of the band, the opening for the shade may open to the inside surface, the outside surface, or the bottom edge of the band.

These and other objects and advantages of the present invention will be apparent from a review of the following specification and accompanying drawings.

DESCRIPTION OF THE PREFERRED EMBODIMENT(S)

The detailed description set forth below in connection with the appended drawings is intended as a description of presently preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
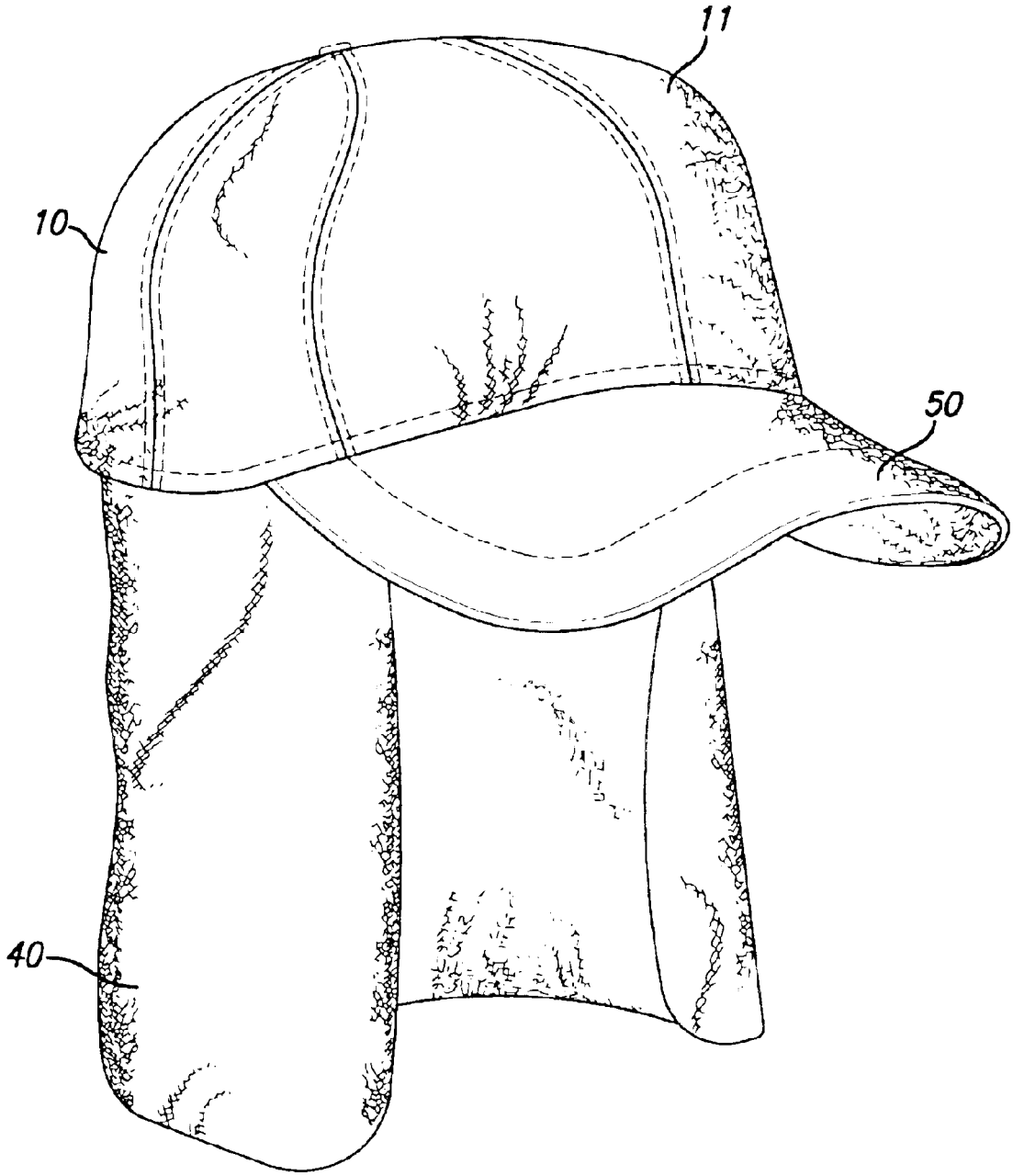
FIG. 1 is a perspective view of one embodiment of the present invention.
Figure 2:
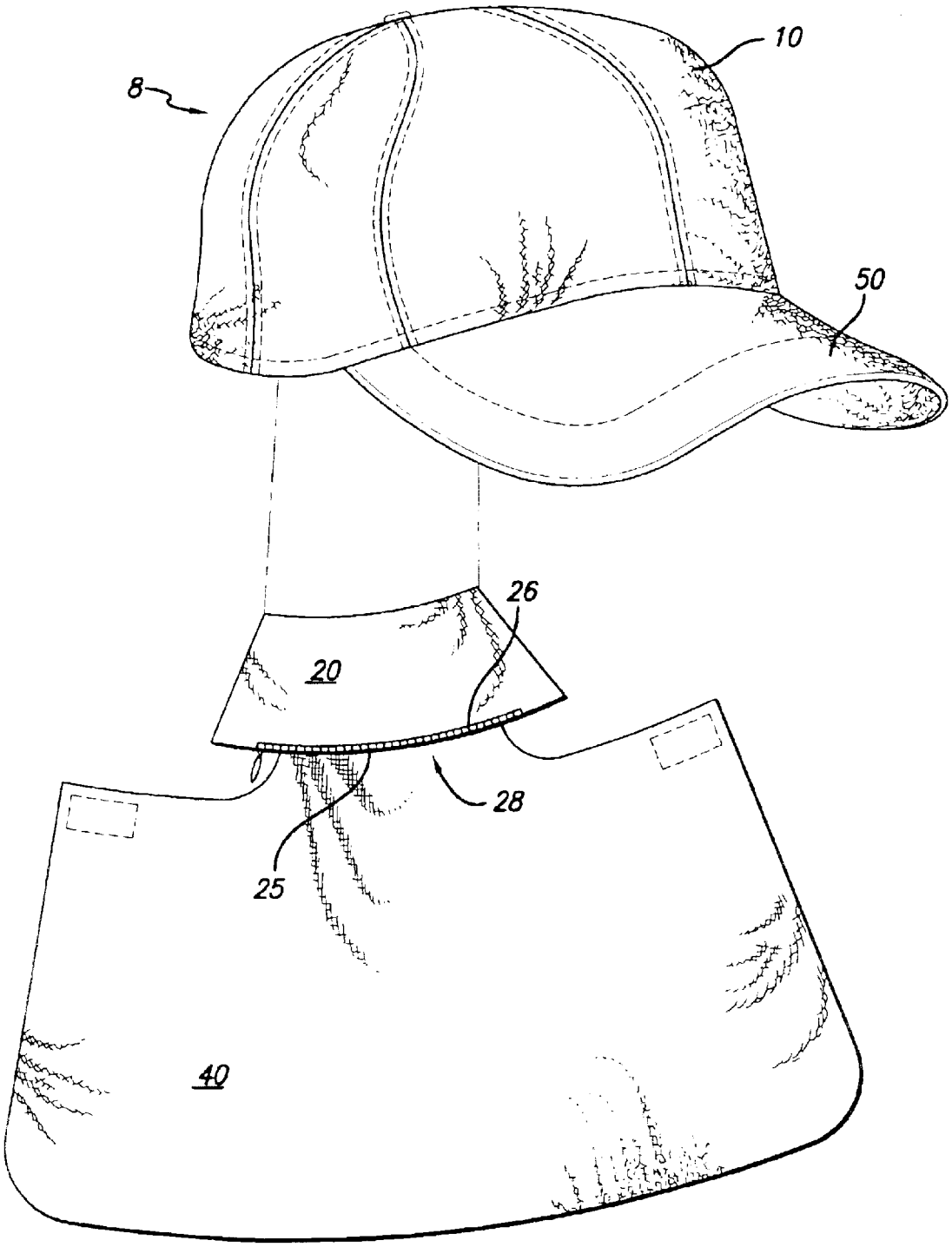
FIG. 2 is an exploded perspective view of the embodiment shown in FIG. 1.

FIGS. 1 and 2 illustrate one embodiment of the present invention, in which there is a cap 8 comprising a crown 10 that is generally convex in shape to fit over and around a portion of the wearer's head. The crown 10 has an outer surface 11, an inner surface 12, and a bottom portion 18. In this embodiment, there also is a visor 50 attached to a front portion 16 of the crown 10, which may be of any standard length and curvature to help shade the wearer's eyes from the sun's rays. In this embodiment, the cap 8 itself appears much like a standard baseball cap when viewed from the outside.

Figure 3:
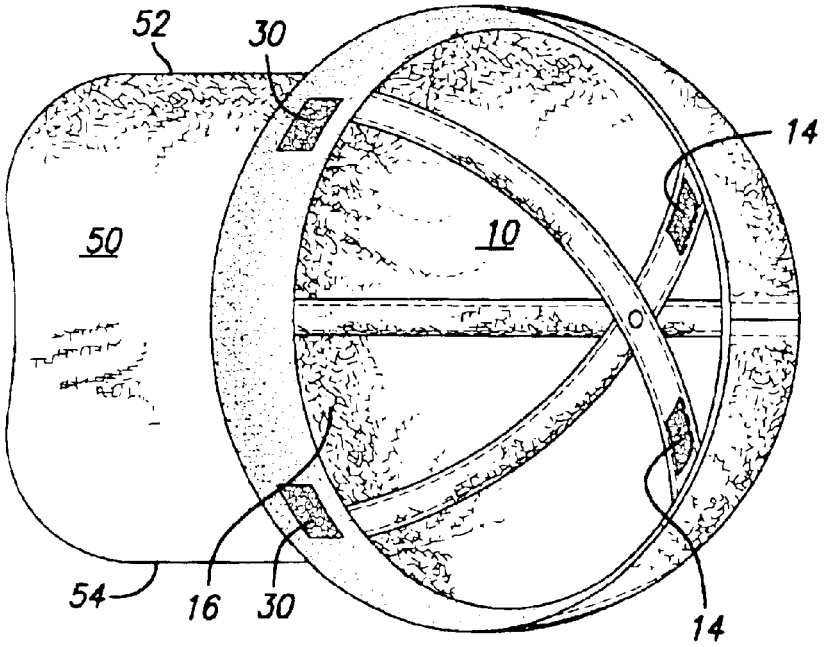
FIG. 3 is a bottom view of a cap in accordance with one embodiment of the present invention.
Figure 4:
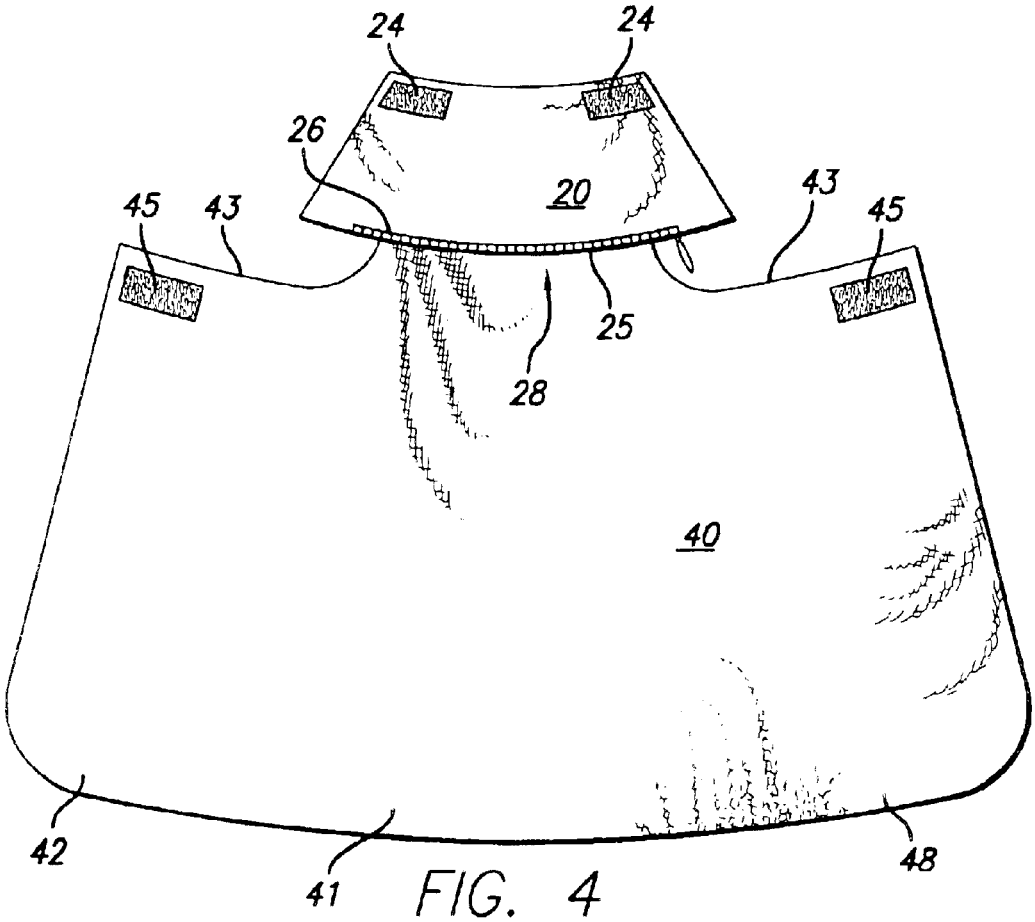
FIG. 4 is a side vide of the backside of a shade in accordance with an embodiment of the present invention.
Figure 5:
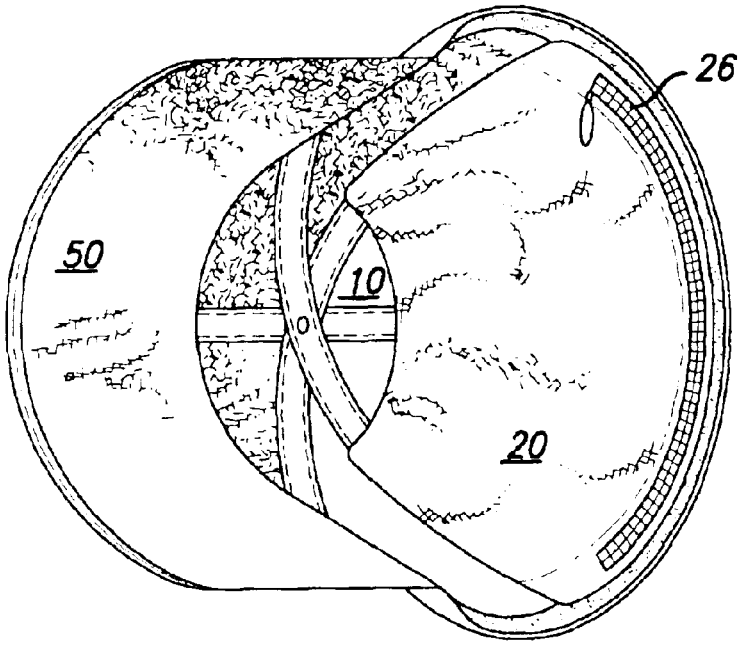
FIG. 5 is a bottom view of an embodiment of the present invention showing a pouch and cap combination in accordance with one embodiment of the present invention.

The inner surface 12 of the crown 10, however, comprises one or more connecting structures 14 as shown in FIG. 3 for securing a pouch 20 to the inner surface 12 of the crown 10 as shown in FIG. 5. The connecting structures 14 shown in FIG. 3 represent one half of a common hook and loop arrangement, and the mating hook and loop structures 24 are located on the backside of the pouch 20 as shown in FIG. 4. The inner surface 12 of the crown 10 also has two or more shade attachment members 30 for receiving mating attachment members 45 as discussed below.

The pouch 20 may be attached to the inner surface 12 of the crown 10 by a number of other connecting structures. The pouch 20 and crown 10, for example, may be stitched together. In such an embodiment, the pouch 20 may not be easily removed from the crown 10. This may be preferable in applications where there is no foreseeable reason to want the pouch 20 to be easily removable from the cap 8 or where easy removal of the pouch 20 from the cap 8 even may be undesirable. In other applications, the pouch 20 may be removably connected to the inner surface 12 of the crown 10 by one or more fastening means, such as buttons, snaps, clasps, latches, or the like, as an alternative to the hook and loop arrangement illustrated in FIGS. 3 and 4.

The pouch 20 has an opening 28 defined by one or more edges 25. In one embodiment, a zipper 26 is disposed along edges 25 so that the opening 28 may be closed when desired as shown in FIG. 5. Alternatively, one or more other fastening means may be employed along the edges 25 of the pouch 20, such as one or more buttons, snaps, clasps, latches, hook and loop fasteners, or the like, for closing the opening 28 of the pouch 20.

Contained within the pouch 20 is a shade or sunshade 40. One end of the shade 40 is attached to the inner surface of the pouch 20, and the shade further comprises a central portion 41, a left side portion 42, and a right side portion 48 as shown in FIG. 2. The left and right side portions each have an upper edge 43 having one or more mating shade attachment members 45. Each mating attachment member 45 is configured and positioned to attach to the shade attachment member 30 on the inner surface 12 of the cap 8. The shade attachment members 30 and mating attachment members 45 shown in FIGS. 3 and 4, respectively, are made of a common hook and loop configuration, but the present invention contemplates any number of other fastening arrangement that would work equally as well, provided that the fastening means allows for easy unfastening as well by the user. Such is the case with many commercially available fasteners, including for example, buttons, snaps, latches, clasps, and the like.

In a preferred embodiment, the two or more mating attachment members 30 are disposed on the inner surface 12 of the crown 10 of cap 8 near the front of the crown 10. The inner surface 12 is utilized in this embodiment to reduce the chances that the shade 40 would be inadvertently unfastened while it is unfurled and in use with the cap 8 is on the wearer's head. That is, whereas U.S. Pat. No. 6,131,201 may suggest that the shade can be attached to the outer surface of the cap, a preferred embodiment of the present invention uses shade attachment members 30 located on the inner surface 12 of the crown 10. As a result, the mating attachment members 45 and upper edges 43 of shade 40 are sandwiched between the crown 10 and the wearer's head. This significantly improves that attachment between the shade 40 and the crown 10 when the user is wearing cap 8.

Additionally, U.S. Pat. No. 6,131,201 may suggest that shade attachment members on the crown may be placed on the side of the crown, but the shade attachment members 30 on the crown 10 in one embodiment of the present invention are instead located in the front portion 16 of crown 10 near the left and right edges 52 and 54, respectively, of the visor 50. This frontal placement of the shade attachment members 30 maximizes the surface of the user's head, neck, and shoulders that is shaded from the sun's rays by the shade 40.

In FIGS. 3 and 4, the shade attachment members 30 and mating attachment members 45 are illustrates as a hook and loop arrangement, but other fasteners work equally as well, such as buttons, snaps, clasps, latches, and the like. The upper edges 43 of said right and left side portions 42 and 48, respectively, may also comprise an elastic portion for tightly conforming to a user's head or for further aiding the mating of the shade attachment members and the mating attachment members 30 and 45.

Figure 6:
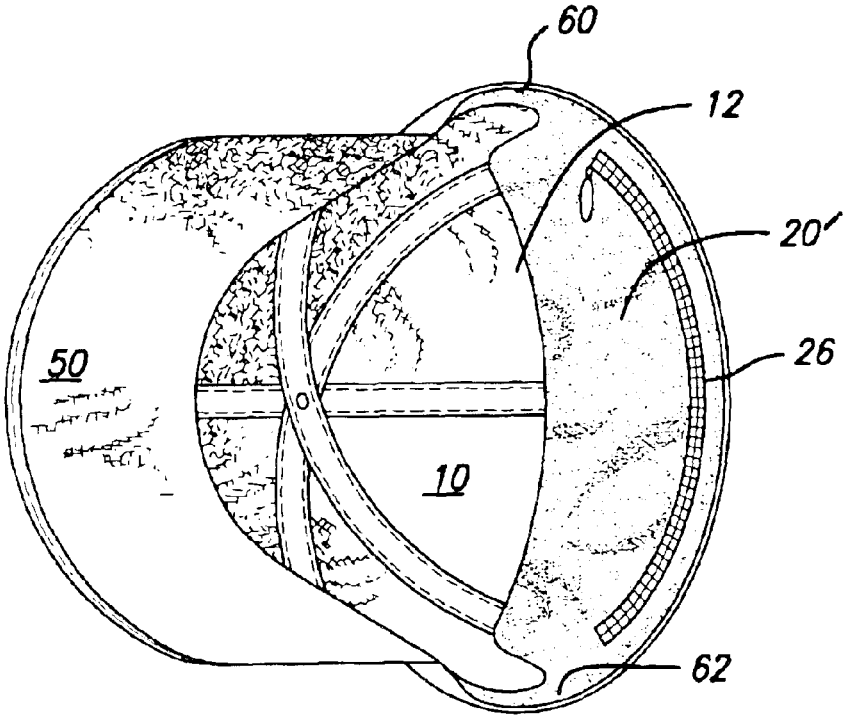
FIG. 6 is a bottom view of an embodiment of the present invention showing a pouch and cap combination in accordance with another embodiment of the present invention.

In another embodiment, shown in FIG. 6, a band or sweatband 60 is attached along the bottom edge 18 of crown 10, and pouch 20' is sewn or otherwise attached to the band 60. The pouch 20' of this embodiment is much like the pouch 20 discussed above, and a preferred embodiment is configured such that the opening 28 of the pouch 20' opens along the inside surface 62 of band 60, as shown in FIG. 6. Alternatively, pouch 20' could be configured to open on the outside surface of band 60, or to open along the bottom edge of band 60. Also, the pouch 20' shown in FIG. 6 may be integrally formed in the sweatband 60, but it may alternatively be made as a separate unit sewn onto or removably attached to the sweatband 60, either on its inside surface, on its outside surface, or along its bottom edge, depending on the needs of the particular application.

Figure 7:
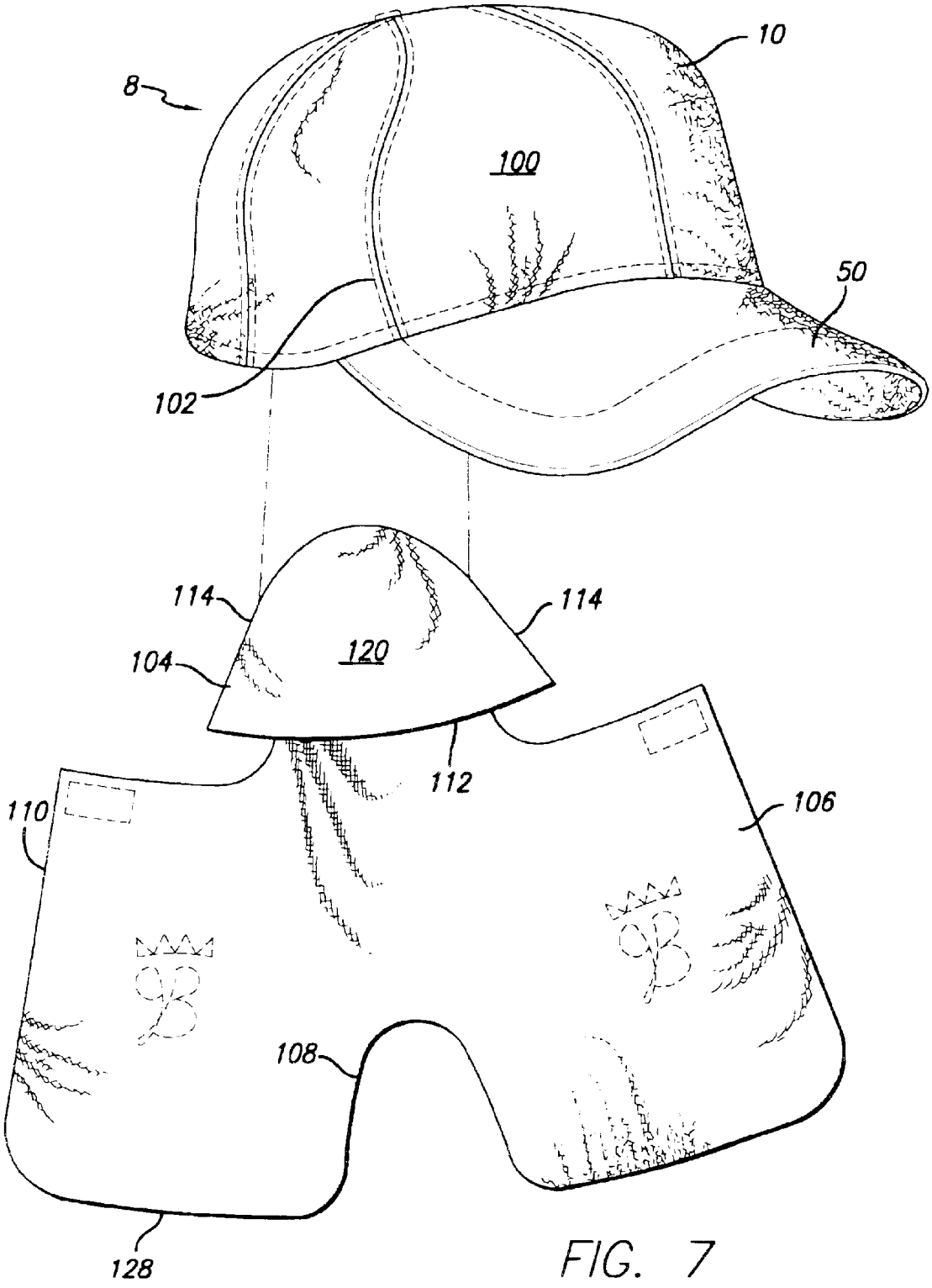
FIG. 7 is an exploded perspective view of another embodiment of the invention.

Referring to FIG. 7 it will be seen that the cap 8 comprises a crown 10 with a visor 50 and is thus far like the cap previously described in being made up of gores 100 which are sewn to each other by lines of stitching 102.

In this embodiment a pouch not seen is formed by reason of a gore shaped fabric segment 104 being sewn along the gore lines or stitch lines 102 on the interior of the cap 8 so as to form an interior pouch not seen within which the back shade 106 having what may be considered a dove-tail configuration by reason of the inwardly cut 108 may be received.

It will be noted that the back shade 106 is as previously described with respect to to the attachment numbers on the lateral sides and differs only in that an exterior surface 110 may have a design 112 as shown in dotted line. It will be noted that the back shade 106 is secured to the free edge 112 of member 104 which is sewn along the opposed edges 114 within cap 8 as previously described. By reason of the free edge 112 a pouch is formed by the reason of the fabric segment 104 being slightly larger than the space between the seam lines 102 of the gores 100 and thus there is formed an enclosure or pouch by reason of co-action of the surface 120 of segment 114 and the interior of the crown 10 of cap 8.

Ideally, as indicated, the cloth segment 104 forming the pouch is of lightweight material as is the back shade 106, preferably of silk or the like, so that the back shade as well as the pouch forming segment 104 may be easily received within the interior of the crown of cap 8. The provision of the split tail or cut-in 108 of the lower edge 128 of back shade 106 makes for ease of folding so that the entirety of back shade 106 is easily received within the pouch.

While the present invention has been described with regards to particular embodiments, it is recognized that additional variations of the present invention may be devised without departing from the inventive concept.

What is claimed is:

1. A cap having a plurality of gores and comprising:

a crown having an inner surface and an outer surface, two or more shade attachment members on said inner surface of said crown near a front portion thereof, a pouch attached to said crown, and a shade contained within said pouch said shade comprising a central portion, a left side portion, and a right side portion, said left and right side portions each having an upper edge comprising one or more mating attachment members, said shade having a split configuration, wherein said at least one mating attachment members of said left and right side portions are configured and positioned to attach to said shade attachment members during use.

2. The cap as defined by claim 1 wherein said pouch is formed by a fabric member having a configuration of one of said gores and is attached to said inner surface of said crown by stitching.

3. The cap as defined by claim 2 wherein said pouch is pyramid-like in shape.

4. The cap as defined by claim 3 wherein said fabric member is of relatively light weight.

5. The cap as defined by claim 4 wherein said shade has a dove-tail like configuration and is fabricated of light weight material.

6. The cap as defined by claim 5 wherein said shade has a design imprinted on the surface thereof adapted to be exposed when in the unfolded condition.

7. The cap as defined by claim 6 wherein shade is of silk material.

8. A cap having a plurality of gores and comprising:

a crown having an inner surface and an outer surface, two or more shade attachment members on said inner surface of said crown near a front portion thereof, a pouch attached to said crown wherein said pouch is formed by a fabric member having a configuration of one of said gores and is attached to said inner surface of said crown by stitching, and a shade contained within said pouch said shade, comprising a central portion, a left side portion, and a right side portion, said left and right side portions each having an upper edge comprising one or more mating attachment members, said shade having a split configuration, wherein said at least one mating attachment members of said left and right side portions are configured and positioned to attach to said shade attachment members during use.

9. The cap as defined by claim 8 wherein said pouch is pyramid-like in shape.

10. The cap as defined by claim 9 wherein said fabric member is of relatively light weight.

11. The cap as defined by claim 10 wherein said shade has a dove-tail like configuration and is fabricated of light weight material.

12. The cap as defined by claim 11 wherein said shade has a design imprinted on the surface thereof adapted to be exposed when in the unfolded condition.

13. The cap as defined by claim 12 wherein shade is of silk material.

* * * * *